US011849864B2

(12) United States Patent
Nagel

(10) Patent No.: US 11,849,864 B2
(45) **Date of Patent: *Dec. 26, 2023**

(54) RETAIL MERCHANDISE TRAY WITH MOUNTING, SPACING, AND LOCATING

(71) Applicant: Fasteners for Retail, Inc., Twinsburg, OH (US)

(72) Inventor: Thomas O. Nagel, Rockford, IL (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/073,961

(22) Filed: Dec. 2, 2022

(65) Prior Publication Data

US 2023/0095417 A1 Mar. 30, 2023

Related U.S. Application Data

(63) Continuation of application No. 17/381,339, filed on Jul. 21, 2021, now Pat. No. 11,517,127.
(Continued)

(51) Int. Cl.
*A47F 1/12* (2006.01)
*A47F 5/00* (2006.01)
(Continued)

(52) U.S. Cl.
CPC ..... *A47F 1/126* (2013.01); *A47B 45/00* (2013.01); *A47B 57/586* (2013.01);
(Continued)

(58) Field of Classification Search
CPC ..... A47F 1/126; A47F 1/125; A47F 1/128; A47F 5/005; A47F 5/0093; A47F 5/08;
(Continued)

(56) References Cited

U.S. PATENT DOCUMENTS 2,522,896 A 9/1950 Milton et al.
3,357,597 A 12/1967 Groff
(Continued)

FOREIGN PATENT DOCUMENTS

CN 101779876 A 7/2010
CN 102970901 A 3/2013
(Continued)

OTHER PUBLICATIONS

U.S. Appl. No. 17/992,268, filed Nov. 22, 2022, Nagel.
U.S. Appl. No. 18/090,118, filed Dec. 28, 2022, Nagel.
U.S. Appl. No. 17/381,339, filed Jul. 21, 2021, Patented.

*Primary Examiner* — Jennifer E. Novosad
(74) *Attorney, Agent, or Firm* — Reinhart Boerner Van Deuren P.C.

(57) ABSTRACT

The retail merchandise tray has a load bearing member formed from a rail attached to a mounting plate. The mounting plate and rail form a downward opening notch for mounting to a tray support structure. The tray may have a locating flange that carries a locating pin that engages a tray support structure. The locating pin locates the tray along the tray support structure. The tray may have at least one divider assembly. The divider assembly includes outward extending offset projections that can prevent an adjacent tray from contacting the divider wall.

30 Claims, 13 Drawing Sheets

Related U.S. Application Data

(60) Provisional application No. 63/061,539, filed on Aug. 5, 2020.

(51) Int. Cl.

| | |
|---|---|
| ***A47B 96/02*** | (2006.01) |
| ***A47B 57/58*** | (2006.01) |
| ***A47B 96/06*** | (2006.01) |
| ***A47F 5/08*** | (2006.01) |
| ***A47B 45/00*** | (2006.01) |

(52) U.S. Cl.
CPC ..... *A47B 96/025* (2013.01); *A47B 96/027* (2013.01); *A47B 96/061* (2013.01); *A47F 1/125* (2013.01); *A47F 1/128* (2013.01); *A47F 5/005* (2013.01); *A47F 5/0093* (2013.01); *A47F 5/0838* (2013.01); *A47B 2230/0003* (2013.01)

(58) Field of Classification Search
CPC ... A47F 5/0838; A47B 57/586; A47B 96/025; A47B 96/027; A47B 2230/0003; A47B 96/067; A47B 96/061; A47B 45/00
USPC ..... 211/193, 87.01, 7, 175, 59.2, 59.3, 184; 248/235, 241, 250
See application file for complete search history.

(56) References Cited

U.S. PATENT DOCUMENTS 4,457,512 A 7/1984 Stevenson
4,730,741 A 3/1988 Jackle, III et al.
4,865,205 A 9/1989 Thorneburg et al.
4,887,737 A 12/1989 Adenau
4,907,707 A * 3/1990 Crum ..... A47F 5/0093 206/556
5,009,334 A 4/1991 Bodkins
5,012,936 A 5/1991 Crum
5,069,349 A 12/1991 Wear et al.
5,088,607 A 2/1992 Risafi et al.
5,097,968 A * 3/1992 Gregory ..... A47F 5/0838 206/338
5,133,463 A 7/1992 Meri
5,205,524 A 4/1993 Cohen
5,240,125 A 8/1993 Kunz
5,295,592 A 3/1994 Thorne
5,366,099 A 11/1994 Schmid
5,390,802 A 2/1995 Pappagallo et al.
5,425,461 A * 6/1995 Larson ..... A47F 5/0838 211/88.01
5,441,161 A * 8/1995 Merl ..... A47F 5/0869 211/59.1
5,456,435 A 10/1995 Sweeney
5,458,248 A 10/1995 Alain
5,484,068 A 1/1996 Huang
5,634,564 A 6/1997 Spamer et al.
5,665,304 A * 9/1997 Heinen ..... A47F 1/126 211/59.3
5,673,801 A * 10/1997 Markson ..... A47F 1/126 211/59.3
5,855,283 A * 1/1999 Johnson ..... A47F 1/126 211/59.3
5,865,324 A 2/1999 Jay et al.
5,992,648 A 11/1999 Saunders
6,003,685 A 12/1999 Malin
6,047,647 A 4/2000 Laraia, Jr.
6,082,558 A 7/2000 Battaglia
6,142,317 A 11/2000 Meri
6,164,462 A * 12/2000 Mumford ..... A47F 5/0093 211/90.03
6,179,136 B1 1/2001 Kluge et al.
D453,273 S 2/2002 Goodman et al.
6,364,136 B1 4/2002 Weshler et al.
6,378,727 B1 4/2002 Dupuis et al.
6,719,152 B1 4/2004 Nagel et al.
6,745,906 B1 6/2004 Nagel
6,767,234 B1 * 7/2004 Rosa ..... A47F 11/10 439/327
6,866,155 B2 3/2005 Nagel
6,866,156 B2 3/2005 Nagel et al.
6,866,700 B2 3/2005 Amann
6,889,855 B2 5/2005 Nagel
6,923,330 B1 8/2005 Nagel
6,955,268 B2 10/2005 Waldron
7,032,761 B2 4/2006 Nagel
7,419,062 B2 9/2008 Mason
7,424,957 B1 9/2008 Luberto
7,458,473 B1 12/2008 Mason
7,665,618 B2 * 2/2010 Jay ..... A47F 1/12 211/59.4
7,681,744 B2 * 3/2010 Johnson ..... A47F 1/126 211/59.3
7,690,519 B2 4/2010 Kahl et al.
7,850,015 B1 12/2010 Mason
7,850,075 B1 12/2010 Rosemore et al.
7,854,334 B2 12/2010 Nagel et al.
7,857,148 B2 12/2010 Roeske
7,882,964 B2 * 2/2011 Battaglia ..... A47F 5/0823 248/302
7,918,353 B1 4/2011 Luberto
7,931,156 B2 4/2011 Hardy
8,210,365 B2 7/2012 Van Wyk
8,210,367 B2 7/2012 Nagel et al.
8,317,038 B2 11/2012 Luberto et al.
8,397,922 B2 3/2013 Kahl et al.
8,448,792 B2 5/2013 Gelardi et al.
8,453,851 B2 * 6/2013 Ciesick ..... A47F 1/126 211/59.3
8,485,391 B2 7/2013 Vlastakis et al.
8,622,227 B2 1/2014 Bird et al.
8,646,621 B2 2/2014 Zacherle et al.
8,657,126 B1 2/2014 Loftin et al.
8,720,702 B2 * 5/2014 Nagel ..... A47F 1/04 211/59.3
8,727,179 B2 5/2014 Colelli et al.
8,893,901 B2 * 11/2014 Nagel ..... A47B 57/42 211/59.3
8,893,902 B2 11/2014 Dotson et al.
9,016,484 B2 * 4/2015 Kologe ..... A47F 5/0025 211/59.3
9,138,075 B2 9/2015 Hardy et al.
9,241,583 B2 1/2016 Nagel
9,254,049 B2 * 2/2016 Nagel ..... A47F 3/0486
9,357,856 B2 * 6/2016 Szpak ..... A47F 1/12
9,629,479 B2 * 4/2017 Sosso ..... A47F 5/0018
9,629,480 B2 * 4/2017 Ewing ..... A47F 1/128
9,713,394 B1 7/2017 Bruegmann
9,770,122 B2 * 9/2017 Gonzalez ..... A47B 95/008
9,801,466 B2 10/2017 Hardy
9,986,852 B2 6/2018 Chenoweth et al.
10,034,557 B1 * 7/2018 Nagel ..... A47F 1/126
10,251,494 B1 * 4/2019 Nagel ..... A47F 5/005
10,470,587 B2 11/2019 Nagel
10,492,627 B2 12/2019 Nagel
10,617,228 B2 4/2020 Nagel
10,694,869 B2 6/2020 Nagel
10,709,263 B2 7/2020 Nagel
10,786,094 B2 * 9/2020 Bruegmann ..... A47F 5/005
10,842,294 B2 11/2020 Nagel
10,912,398 B2 * 2/2021 Wills ..... A47F 7/0007
10,952,547 B2 3/2021 Nagel
10,952,548 B2 * 3/2021 Pollpeter ..... F21S 4/28
11,350,768 B2 6/2022 Nagel
11,350,769 B2 6/2022 Nagel
11,510,507 B2 11/2022 Nagel
11,517,127 B2 * 12/2022 Nagel ..... A47F 5/005
2002/0139912 A1 * 10/2002 Shiojima ..... A47F 5/0838 248/220.21
2003/0000956 A1 1/2003 Maldonado
2003/0057167 A1 3/2003 Johnson et al.
2003/0217980 A1 11/2003 Johnson et al.

(56) References Cited

U.S. PATENT DOCUMENTS

2004/0000528 A1 1/2004 Nagel
2004/0050812 A1 3/2004 Rojas et al.
2004/0079715 A1 4/2004 Richter et al.
2004/0168996 A1 9/2004 Jones
2005/0072747 A1 4/2005 Roslof et al.
2005/0077260 A1 4/2005 Mueller et al.
2005/0092702 A1 5/2005 Nagel
2005/0127014 A1 6/2005 Richter et al.
2005/0166806 A1 8/2005 Hardy
2006/0180603 A1 8/2006 Eckert
2006/0186064 A1 8/2006 Merit et al.
2006/0186065 A1 8/2006 Ciesick
2006/0273053 A1 12/2006 Roslof et al.
2007/0007221 A1 1/2007 Mann
2007/0068885 A1 3/2007 Busto et al.
2007/0138114 A1 6/2007 Dumontet
2007/0170127 A1 7/2007 Johnson
2007/0175839 A1 8/2007 Schneider et al.
2009/0200906 A1 8/2009 Dao
2009/0223916 A1* 9/2009 Kahl ..... A47F 1/12 211/85.4
2010/0025346 A1 2/2010 Crawbuck et al.
2010/0032392 A1 2/2010 Camello et al.
2010/0107670 A1 5/2010 Kottke et al.
2010/0108624 A1 5/2010 Sparkowski
2010/0176075 A1 7/2010 Nagel et al.
2011/0017684 A1 1/2011 Nagel et al.
2011/0017763 A1 1/2011 Colelli et al.
2011/0174750 A1 7/2011 Poulokefalos
2011/0210086 A1 9/2011 Ciesick
2011/0215060 A1 9/2011 Niederhuefner
2011/0215061 A1 9/2011 Niederhuefner et al.
2011/0290749 A1* 12/2011 Neumann ..... A47F 5/0838 248/241
2012/0048817 A1 3/2012 Green et al.
2012/0091079 A1 4/2012 Schwester et al.
2012/0103922 A1 5/2012 Bird et al.
2012/0211450 A1 8/2012 Kologe
2012/0234779 A1 9/2012 Schneider et al.
2012/0255924 A1* 10/2012 Kologe ..... A47F 5/0025 211/183
2014/0054310 A1 2/2014 Loftin et al.
2014/0112752 A1 4/2014 Hardy et al.
2014/0167962 A1 6/2014 Valiulis et al.
2014/0190914 A1 7/2014 Nagel
2014/0196807 A1 7/2014 Ikeda
2014/0305889 A1 10/2014 Vogler et al.
2014/0319086 A1 10/2014 Sosso et al.
2014/0319088 A1* 10/2014 Neumann ..... A47F 1/128 211/59.3
2015/0021283 A1 1/2015 Bruegmann
2015/0055434 A1 2/2015 Mader
2015/0068991 A1 3/2015 Kostka
2015/0129520 A1 5/2015 Kologe
2015/0164241 A1* 6/2015 Nagel ..... A47F 1/126 211/59.3
2015/0208830 A1 7/2015 Hardy
2015/0230628 A1* 8/2015 Juric ..... A47F 5/005 211/59.4
2015/0257547 A1 9/2015 Nagel
2015/0289680 A1 10/2015 Sosso et al.
2016/0022035 A1 1/2016 Hardy
2016/0286983 A1 10/2016 Hachmann
2017/0007038 A1* 1/2017 Ewing ..... A47F 1/126
2017/0042343 A1* 2/2017 Ewing ..... A47F 5/0838
2017/0196355 A1 7/2017 Hardy et al.
2017/0202369 A1 7/2017 Mercier et al.
2017/0215602 A1 8/2017 Bruegmann
2017/0224131 A1 8/2017 Murphy
2017/0295958 A1 10/2017 Hassell et al.
2018/0020848 A1 1/2018 Mercier et al.
2018/0070743 A1 3/2018 Hardy
2018/0140113 A1 5/2018 Hardy et al.
2018/0153313 A1 6/2018 Padvoiskis et al.
2022/0039564 A1* 2/2022 Nagel ..... A47F 1/128
2023/0084806 A1* 3/2023 Nagel ..... A47F 1/126
2023/0095417 A1* 3/2023 Nagel ..... A47F 5/0838 211/59.3

FOREIGN PATENT DOCUMENTS

CN 104023594 A 9/2014
CN 204427390 U 7/2015
CN 105029908 A 11/2015
CN 105795790 A 7/2016
CN 205913129 U 2/2017
CN 106742805 A 5/2017
DE 202005019621 U1 2/2006
EP 0437359 B1 11/1995
EP 1864597 A1 12/2007
JP H11155708 A 6/1999
JP H11342054 A 12/1999
JP 2000217674 A 8/2000
WO WO 2005/110165 A1 11/2005
WO WO 2009/117699 A2 9/2009
WO WO 2011/035371 A1 3/2011
WO WO 2017/015466 A1 1/2017
WO WO 2017/127456 A1 7/2017

* cited by examiner

RETAIL MERCHANDISE TRAY WITH MOUNTING, SPACING, AND LOCATING

CROSS-REFERENCE TO RELATED PATENT APPLICATIONS

This patent application is a continuation of U.S. patent application Ser. No. 17/381,339, filed Jul. 21, 2021, which is now pending, which claims the benefit of U.S. Provisional Patent Application No. 63/061,539, filed Aug. 5, 2020, the entire teachings and disclosure each of which are incorporated herein by reference thereto.

FIELD OF THE INVENTION

This invention generally relates to retail merchandise displays and particularly retail merchandise displays that include pusher trays.

BACKGROUND OF THE INVENTION

Self-facing retail merchandise displays are generally known in the art. One such display is the pusher system. A conventional pusher system incorporates one or more pusher paddles or pusher bodies that ride along a respective elongated track. A spring is connected between the pusher body and a leading edge of the track. The spring acts to bias the pusher body forward along the track towards the leading edge thereof.

A user can retract the pusher body away from the leading edge of the track and position items of retail merchandise in a linear row on top of the track and between the leading edge of the track and the pusher body. The biasing force provided by the spring and exerted upon the pusher body serves to bias the linear row of retail merchandise forward to ultimately "front face" the merchandise.

That is, when a customer removes the leading most item of merchandise from the linear row of merchandise, the pusher body will be drawn forward by the spring to index the row of merchandise forward so that the next item of merchandise in the row is positioned proximate the leading edge of the track in an aesthetically pleasing manner. Such automatic front facing eliminates the necessity for retail store employees to manually face the merchandise, and thus ultimately reduces the cost of labor of the retailer.

The aforementioned pusher systems have been utilized in various retail display environments. One example is a retail shelf. Typically, a plurality of pusher bodies and their corresponding tracks are arranged in a side by side manner along the shelf. Each pusher body and its corresponding track are separated by dividers to maintain a plurality of generally straight rows of merchandise that run from the front to the back of the shelf. Such a familiar configuration can be found in many retail stores for selling hygiene items such as deodorant, as one example.

In another configuration, the pusher system may be embodied as a stand-alone pusher tray. These trays may include means for mounting the tray as a cantilevered extension from another structure, such as a tray support structure that may take the form, in some implementations, as a horizontal bar. Further, these trays may include side barriers (also referred to as dividers) which are adjustable so as to accommodate merchandise of differing widths. Examples of these trays may be readily seen at U.S. Pat. Nos. 9,254,049; 9,241,583; 8,720,702; 10,034,557; 10,251,494 as well as U.S. Pat. Appl. No. 62/964,476 filed Jan. 9, 2020, each of which is incorporated by reference herein in its entirety.

When the trays are mounted in the cantilevered orientation, a large torque can be applied to the mounting portions of the tray. As such, the mounting structure can have a large dimension parallel to the length of the tray. Unfortunately, this large dimension can make it difficult in tight spaces to mount the tray to the tray support structure (e.g. horizontal bar).

Further, load cells have been used in other retail environments to help determine when merchandise has been removed from a shelf. Unfortunately, when adjacent trays contact one another, the engagement can interfere with the analysis used to determine what product or how much product has been removed from a particular tray. Further yet, the position of the tray along a horizontally extending bar that supports multiple trays is important in the calculations to determine how much and which product was removed from which tray.

The invention relates to improvements in the above described pusher systems, more particularly, the above described pusher trays mounted in cantilevered fashion to a horizontal bar. These and other advantages of the invention, as well as additional inventive features, will be apparent from the description of the invention provided herein.

BRIEF SUMMARY OF THE INVENTION

New and improved retail merchandise trays and retail merchandise displays using retail merchandise trays are provided.

In an embodiment, a retail merchandise tray including a product support structure, a product support surface, a front stop and a pusher is provided. The product support structure extends along a first axis between a front end and a rear end. The product support structure includes first and second spaced apart load bearing members. The load bearing members being spaced apart along a second axis perpendicular to the first axis, each of the first and second load bearing members includes a rail and a mounting plate. The rail extends longitudinally generally parallel to the first axis between a first end and a second end. The first end is closer to the front end than the second end. The second end is closer to the rear end than the first end. The rail has opposed inner and outer sides. The rail includes a downward depending abutment that is offset from the second end along the first axis towards the first end. The downward depending abutment faces the second end (e.g. rearward). The mounting plate attaches to the rail proximate the second end. The mounting plate extends along the second axis outward beyond the outer side and inward beyond the inner side of the rail. The mounting plate i spaced apart from the downward depending abutment along the first axis forming a downward opening notch therebetween. The product support surface is supported by the load bearing members. The front stop is operably supported by the pair of load bearing members proximate the front end. The pusher is mounted to the product support structure and movable along the first axis towards and away from the front stop.

In one example, for each of the first and second load bearing members: the mounting plate includes a slot formed therein; and a portion of the rail extends into the slot.

In one example, for each of the first and second load bearing members, the mounting plate is welded to the rail.

In one example, for each of the first and second load bearing members: the mounting plate defines a front face that faces the front end and a rear face that is opposed to the front face that faces away from the front end; the slot is formed by an aperture that extends entirely through the mounting plate and through the front and rear faces; and the rail being welded to the mounting plate by a weld formed in at least the rear face of the mounting plate.

In one example, for each of the first and second load bearing members, the rail extends no farther rearward than the rear face of the mounting plate.

In one example, the mounting plate has a first thickness measured generally parallel to the first axis that is greater than a second thickness of the rail measured generally parallel to the second axis.

In one example, the first thickness is greater than the second thickness.

In one example, the first thickness is less than 0.25 inches and more preferably less than 0.125 inches.

In one example, the second thickness is less than 0.25 inches, more preferably less than 0.125 inches, and more preferably, less than 0.100 inches.

In one example, the first thickness is at least 25% greater than the second thickness and preferably at least 30% greater.

In one example, the downward depending abutment extends downward farther than the mounting plate.

In one example, the tray further includes a locating flange extending downward below the product support surface. The locating flange is spaced forward of the mounting plate along the first axis. A locating pin extends rearward of the locating flange and into axial overlap with the downward opening notch along the first axis.

In one example, the locating flange extends downward farther than the downward depending abutment of each of the first and second rails.

In one example, the locating flange is formed as part of a removable baffle plate that is removably attachable to the product support structure. The removable baffle plate has a longitudinally extending member extending along the first axis and that is positioned below the product support surface.

In one example, the longitudinally extending member extends along the first axis at least 50% the length of the first and second load bearing members and extends along the second axis at least 80% of the spacing between the first and second load bearing members.

In one example, less than 10% of the cross-sectional area of the longitudinally extending member is perforate.

In one example, the longitudinally extending member and the locating flange are formed as a continuous one-piece construction.

In one example, the locating pin is carried by the locating flange.

In one example, the locating flange includes a pin receiving aperture formed therein, the locating pin extending through the pin receiving aperture.

In one example, the tray further includes a first divider assembly. The divider assembly has a divider wall and a pair of wire supports. The wire supports operably attach the divider assembly to the product support structure. The divider wall has an inner side facing the product support structure and an opposed outer side facing away from the product support structure and the inner side. The divider assembly includes an offset projection projecting outward along the second axis from the outer side.

In one example, the divider wall has an aperture extending through the outer side. The offset projection is mounted to the divider wall by having a mounting post pressed into the aperture.

In another example a retail merchandise tray comprising a product support, a product support surface, a locating flange, a locating pin, a front stop and a pusher is provided. The product support structure extends along a first axis between a front end and a rear end. The product support structure includes first and second load bearing members that are spaced apart about a second axis perpendicular to the first axis. Each of the first and second load bearing members includes a downward opening notch. The product support surface is supported by, which may include being provided by, the load bearing members. The locating flange extends downward below the product support surface. The locating flange is spaced forward of the downward opening notch along the first axis. The locating pin extends rearward of the locating flange and into axial overlap with the downward opening notch along the first axis. The front stop is operably supported by the pair of load bearing members proximate the front end. The pusher is mounted to the product support structure and movable along the first axis towards and away from the front stop.

In one embodiment, the locating flange extends downward farther than the portions of the first and second rail that define the downward opening notch of each of the first and second rails.

In one embodiment, the locating flange is formed as part of a removable baffle plate that is removably attachable to the product support structure. The removable baffle plate has a longitudinally extending member extending along the first axis and being positioned below the product support surface. Other embodiments do not require the baffle plate to be removable.

In one embodiment, the longitudinally extending member extends along the first axis at least 50% the length of the first and second load bearing members and extends along the second axis at least 80% of the spacing between the first and second load bearing members.

In one embodiment, less than 5% of the cross-sectional area of the longitudinally extending member is perforate.

In one embodiment, the longitudinally extending member and the locating flange are formed as a continuous one-piece construction.

In one embodiment, the locating pin is carried by the locating flange.

In one embodiment, the locating flange includes a pin receiving aperture formed therein, the locating pin extending through the pin receiving aperture.

In another embodiment, a retail merchandise includes a product support structure and a first divider assembly. The product support structure extends along a first axis between a front end and a rear end. The first divider assembly has a divider wall and a pair of wire supports. The wire supports operably attach the divider assembly to the product support structure. The divider wall has an inner side facing the product support structure and an opposed outer side facing away from the product support structure and the inner side. The divider assembly includes an offset projection projecting outward along the second axis from the outer side.

In one embodiment, the offset projection is mounted to the divider wall by having a mounting post pressed into an aperture extending through the outer side of the divider wall.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now the drawings, FIGS. 1-5 illustrate an embodiment of a retail merchandise tray 100 used in a retail merchandise display for displaying retail merchandise. The retail merchandise tray can take many forms such as those illustrated in U.S. Pat. No. 10,034,557 or 10,251,494 and/or U.S. Pat. Appl. No. 62/964,476 filed Jan. 9, 2020. The retail merchandise tray 100 is configured mount to a tray support structure 103 that provides for limited space for mounting structure of the retail merchandise tray 100. Tray support structure may be mounted to a wall or a gondola wall within a retail environment.

Figure 1:
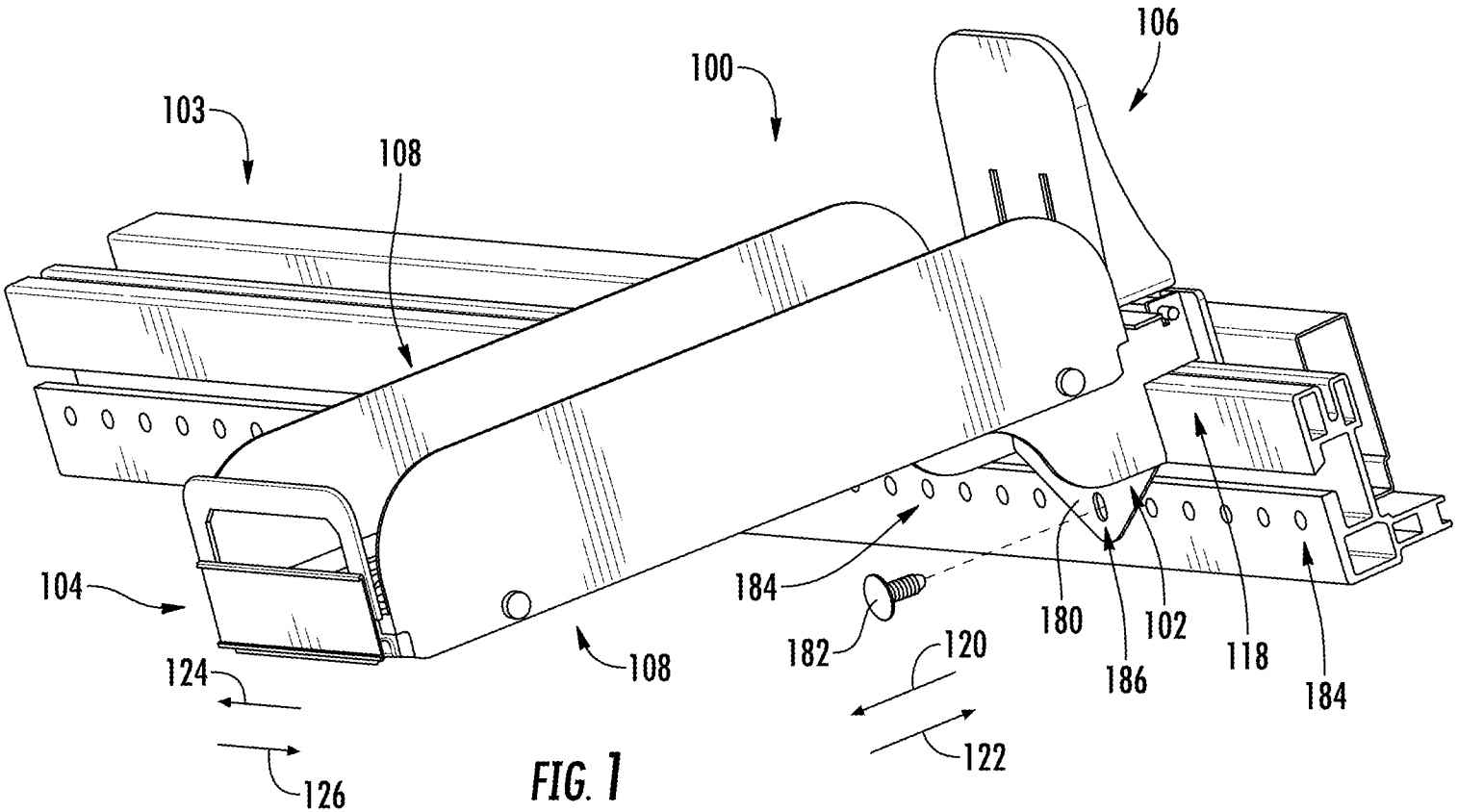
FIG. 1 is a partial perspective view of a retail merchandise display including a retail merchandise tray mounted to a tray support structure.
Figure 2:
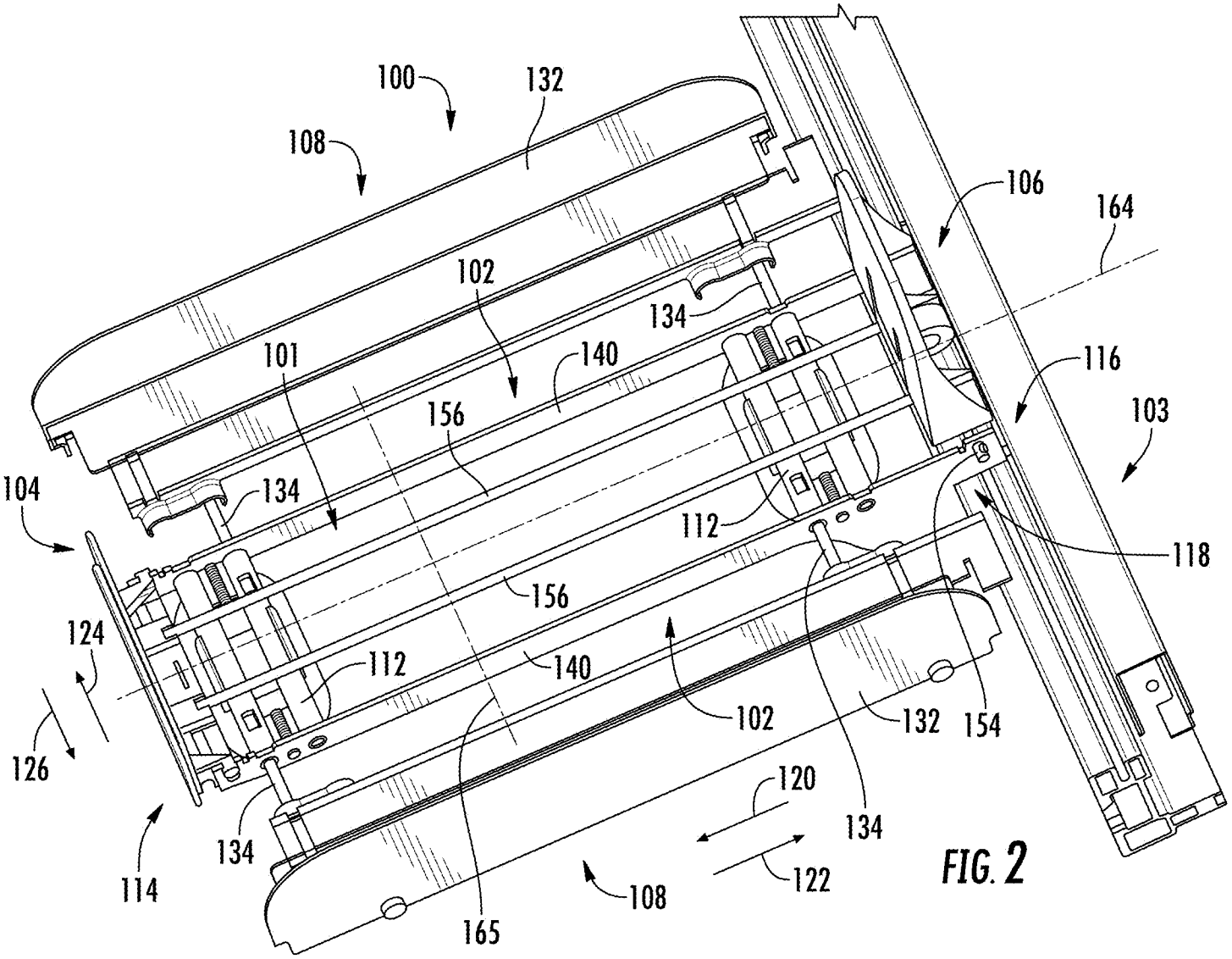
FIG. 2 is an illustration of the tray and tray support structure of FIG. 1 with the tray having the divider assemblies spaced apart to allow for supporting wider product.

With reference to FIGS. 1 and 2, the same illustrate a tray 100 a product support structure (also referred to as a merchandise support frame) 101 that provides a product support surface that vertically supports retail merchandise thereon. In this example, the product support structure 101 has a pair of load bearing members 102 that are laterally spaced apart along axis 165. Load bearing members 102 are identical so a description of one applies equally well to the other. A front stop 104 is connected to the load bearing members at a first end 114 of tray 100. Front stop 104 may include additional integrated or attached structures such as price channel extrusions, faceplates, etc.

With reference to FIG. 2, the product support structure 101 includes, in this embodiment, a wire support frame 110 that is removably to the load bearing members adjacent a second end 116 of tray 100. This wire support frame 110 is also removably attached to front stop 104 adjacent first end 114. Put differently, wire support frame 110 has opposed first and second ends which are adjacent first and second ends 114, 116 of tray 100, respectively.

The first end of wire support frame 110 is removably attached to front stop 104, while the second end is removably attached to load bearing members 102. As used herein, "removably attached" means an attachment which may be readily undone in a non-destructive manner and subsequently repeated in the same manner. Within this meaning "removably attached" does not include welds, comolding, or other permanent forms of attachment which require component destruction or damage to undo.

While the product support structure 101 is illustrated as including the pair of load bearing members 102 and wire support frame 110, other product support structures such as one-piece metal structures, one-piece plastic structures as well as other combinations of metal and plastic structures are contemplated. The product support structure 101 need only be configured to support the merchandise and allow for self facing thereof.

A pusher 106 is mounted to the product support structure 101 and is movable in directions 120, 122 along axis 164 (see FIG. 2). Pusher 106 is operable to bias a row or rows of retail merchandise situated on top of the product support surface of the product support structure from second end 116 of tray 100 toward first end 114 of tray 100. Pusher 106 is biased under the force of a coil spring 180 or other biasing element.

A pair of movable divider assemblies 108 are positioned on either side of tray 100. Divider assemblies 108 are movable in directions 124, 126 along axis 165 (see FIG. 2) to modify a width or distance between the divider assemblies 108. This lateral adjustment allows for the accommodating retail merchandise of differing widths. Divider assemblies 108 employ a removable attachment between their divider walls and wire supports as well as between the divider assemblies 108 and the rest of the product support structure 101.

Figure 3:
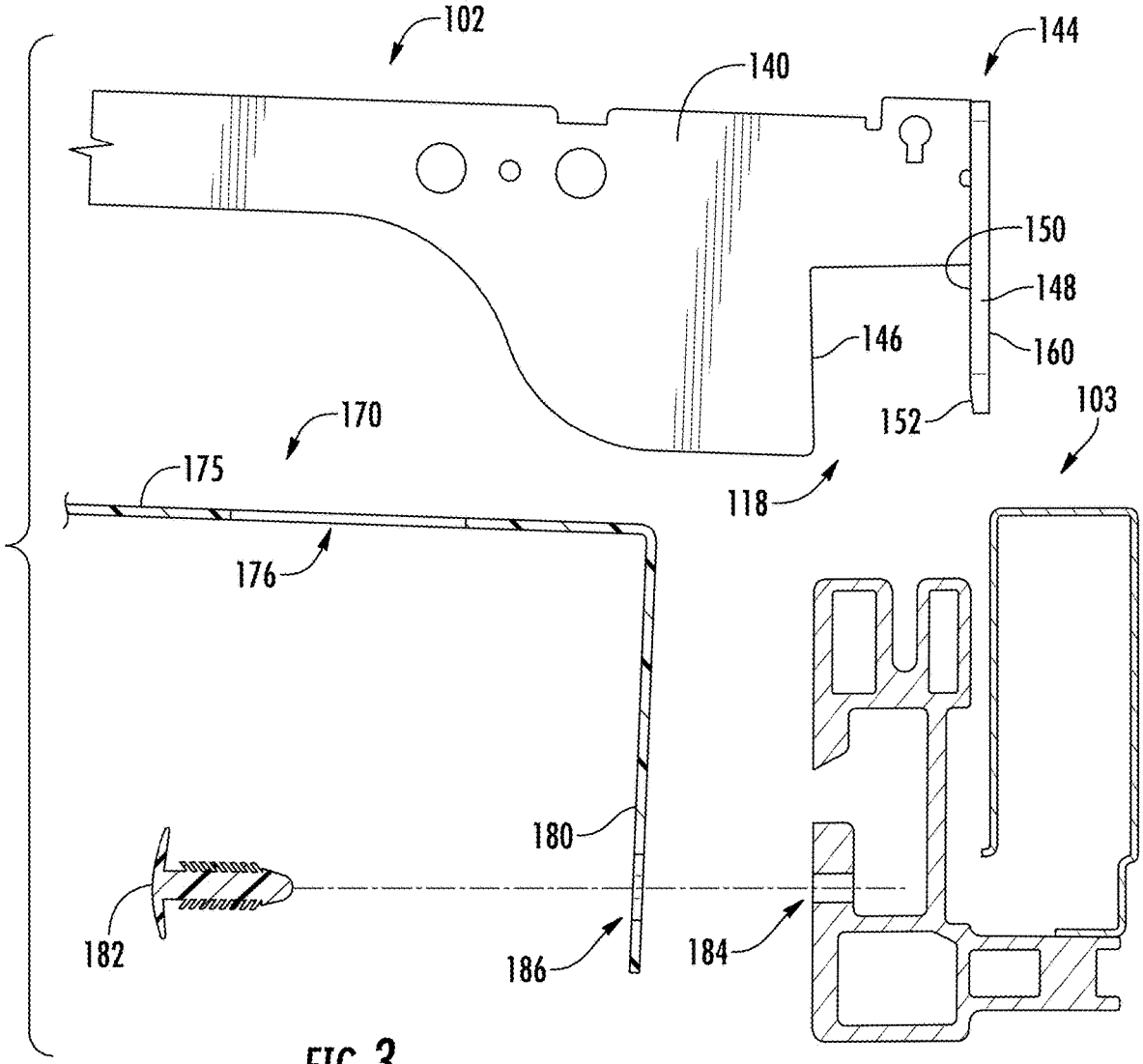
FIG. 3 is a partial exploded view of the tray of FIG. 1 illustrating the tray support structure, a load bearing member, a baffle plate and a locating pin.

As may also be seen in FIGS. 1-3, each load bearing member 102 includes a downward opening notch 118 sized to receive a retail merchandise bar of the type typically found in refrigerated cases or other retail merchandise displays. This allows for a cantilevered mounting of tray 100 to tray support structure 103.

The two divider assemblies 108 shown are identical. As such, a description of one applies equally well to the other. It should also be noted that although two dividers assemblies 108 are shown, only a single divider assembly 108 may be employed in some alternate configurations, while in other alternate configurations, the divider assemblies 108 may be entirely omitted.

Divider assembly 108 includes a divider wall 132 and a pair of wire supports 134 which are removably attached to divider wall 132 (see FIG. 2).

In some embodiments, the pusher 106 may be mounted to the divider assembly 108 (not shown in this embodiment).

With principle reference to FIG. 2, wire support structure 110 includes at least one lateral member 154 and a plurality of longitudinal members 156 extending generally perpendicular to lateral member 154. As its name implies, wire support structure 110 is formed of metal wire, with longitudinal members 156 welded to lateral member 154. Fewer or greater longitudinal members 156 and lateral members 154 may be employed depending on the overall width and length of tray 100.

In this example, the tops of the longitudinal members 156 provides the product support surface. Portions of the load bearing members 102 may be vertically aligned with the tops of the longitudinal members 156 to also provide portions of the product support surface.

Spacers 112 extend transversely between load bearing members 102. Spacers 112 attach to load bearing members 102 via fasteners such as those shown (see FIG. 2), or any other mechanical expedient. This view illustrates wire supports 134 extending through the spacers 112.

In the illustrated example, the front stop 104 is operably mounted to be maintained in an upright orientation. However, other embodiments, may mount the front stop to allow for pivoting between an upright orientation and a reclined orientation. In the upright orientation, the front stop 104 inhibits removal of merchandise from the tray 100. In the reclined orientation, when so constructed, merchandise may be more easily loaded into the tray 100 from the first end 114 of tray 100.

FIGS. 4-9 illustrate one of the load bearing members 102. The load bearing members 102 include a rail 140 that extends longitudinally parallel to the first axis 164 of the tray 100 between the first and second ends 142, 144.

The rail 140 has inner and outer opposed sides. When assembled, the inner side faces the opposed load bearing member and the outer side faces outward toward the adjacent divider wall. The rail 140 provides a downward depending abutment 146 that faces the second end 144 and the rear end of the tray 100, when assembled. The downward depending abutment 146 is proximate to, but spaced away from the second end 144 of the rail 140.

A mounting plate 148 is attached to the rail 140 proximate the second end 144. The mounting plate 148 extends outward beyond the outer side and inward beyond the inner side of the rail 140 (see FIGS. 8 and 9) along the second axis 165. The mounting plate 148 is spaced apart from the downward depending abutment 146 a distance D1 along the first axis 164 forming the downward opening notch 118 between a front face 150 of the mounting plate 148 and the downward depending abutment 146.

The front face 150 of the mounting plate 148 has a tapered lead in surface 152 that allows for easier mounting of the load bearing member 102 and, as such, the tray 100 to tray support structure 103. The tapered surface, tapers rearward when moving downward to make the mouth of the downward opening notch 118 larger than the rest of the notch 118.

With reference to FIGS. 4-7, the mounting plate 148 includes a slot 154 that is in the form of an aperture that extends entirely through the mounting plate 148. The slot 154 that receives a connection portion 156 of rail 140. The connection portion 156 extends rearward of a further rear facing abutment 158 that abuts the front face 150 when the two pieces are assembled. The abutment 158 properly axially locates the mounting plate 148 along first axis 164.

In one implementation, the connection portion 156 of rail 140 has a length L1 (FIG. 4) parallel to axis 164 that is shorter than or equal to the thickness T1 of the mounting plate 148. As such, in this implementation, the connection portion 156 extends no farther rearward than rear face 160.

In a preferred embodiment, the mounting plate 148 is permanently attached to rail 140. More preferably, this attachment is provided by a weld. Further, this weld is preferably formed, at least, in the rear face 160 of the mounting plate 148. In some embodiments, the front face 150 is welded to the rail 140 as well.

The mounting plate 148 has a thickness T1 and the rail 140 has a thickness T2. Preferably, thickness T1 is greater than thickness T2. In some embodiments, the rail 140 and mounting plate 148 are formed from plate metal. In some embodiments, thicknesses T1 and T2 are less than 0.25 inches, more preferably less than 0.125 inches. In one implementation, thickness T2 is less than 0.100 inches. In one implementation, thickness T1 is 0.120 inches (plus or minus 5%) and thickness T2 is 0.089 inches (plus or minus 5%).

In one embodiment, thickness T1 is at least 25% greater than thickness T2 and preferably at least 30% greater than thickness T2.

The applicant had contemplated bending an end of the rail 140 to provide the mounting features provided by mounting plate 140. However, it was contemplated that such bending would not have proper consistency when mass producing these load bearing members 102. Further, it was contemplated that this would only allow a portion of the load bearing member to extend to one side of the rail 140 (e.g. it could only be bent outward or inward).

Figure 4:
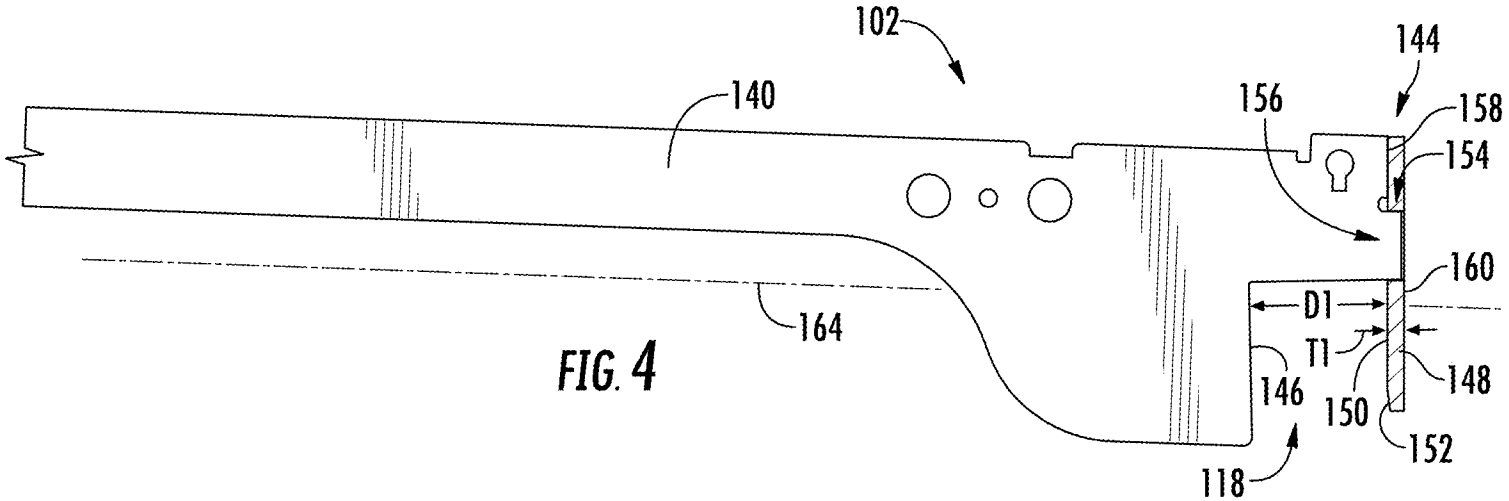
FIG. 4 is a side view and partial cross-sectional illustration of a load bearing member of a tray of FIG. 1.
Figure 5:
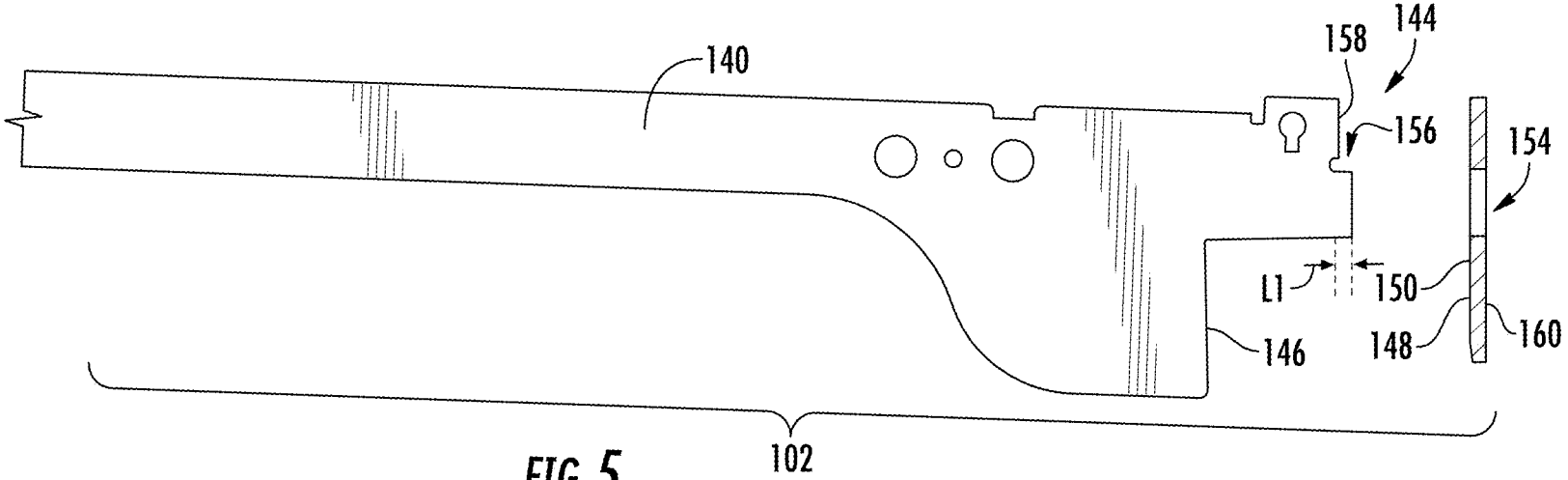
FIG. 5 is a side exploded view of the load bearing member of FIG. 4.
Figure 6:
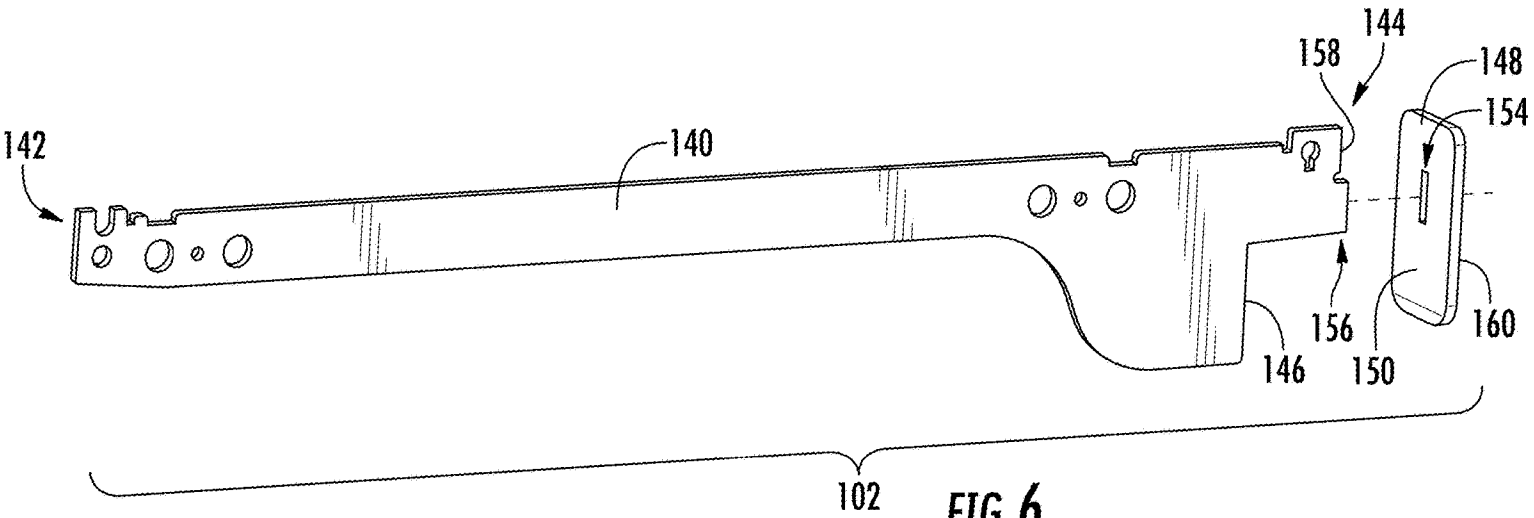
FIGS. 6 and 7 are perspective exploded illustrations of the load bearing member of FIG. 4.
Figure 7:
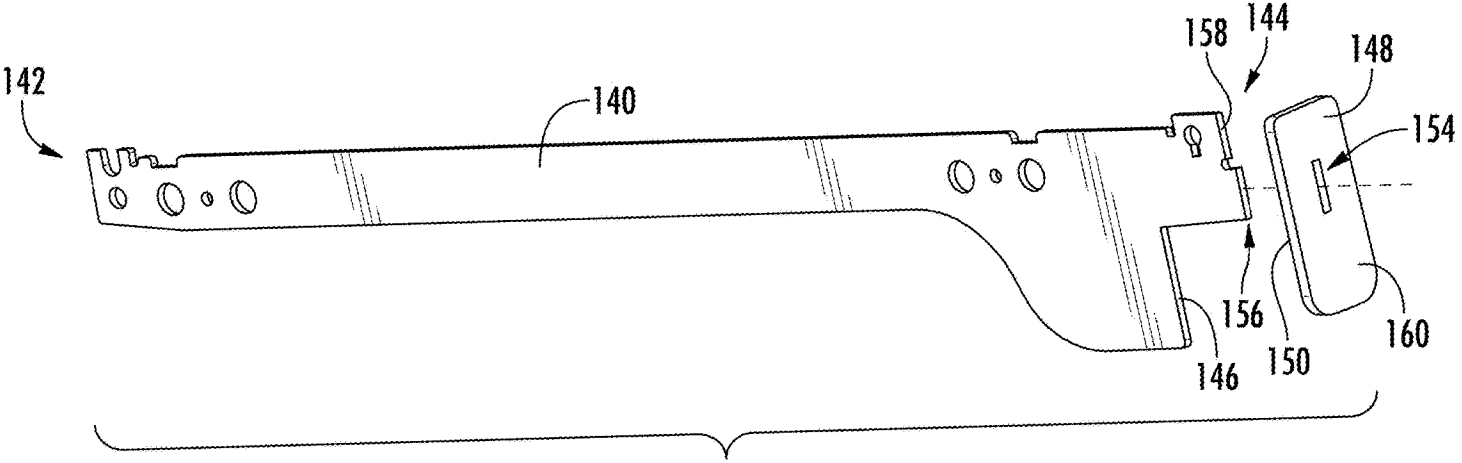
Figure 8:
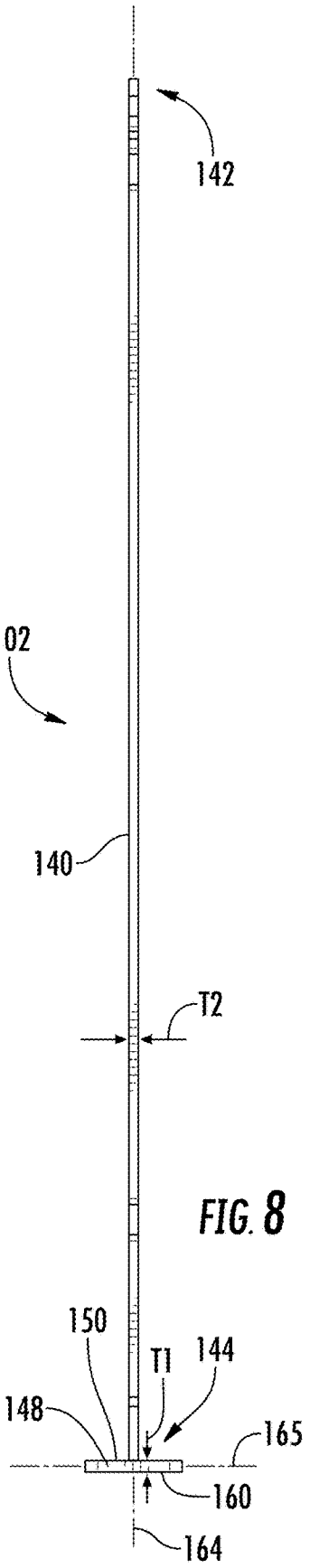
FIG. 8 is a top view of the load bearing member of FIG. 4.
Figure 9:
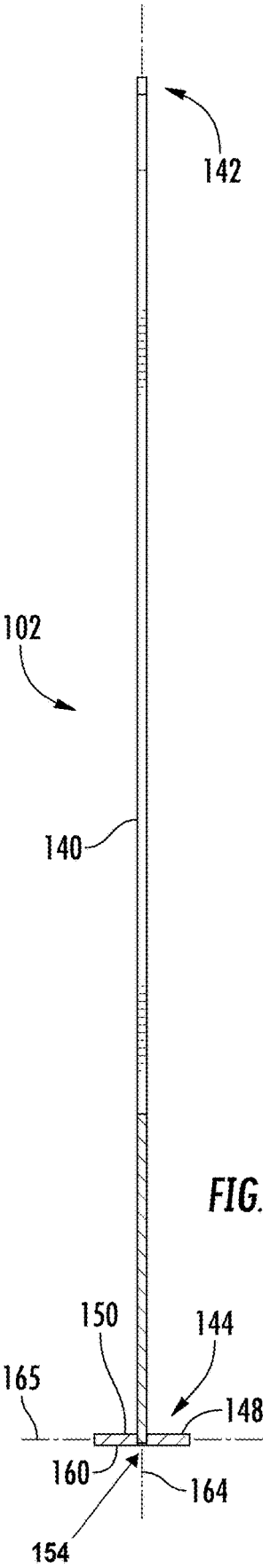
FIG. 9 is a bottom cross-sectional illustration of the load bearing member of FIG. 4.

With reference to FIG. 4, the downward depending abutment 146 extends downward, e.g. perpendicular to axis 164, farther than the mounting plate 148.

Figure 10:
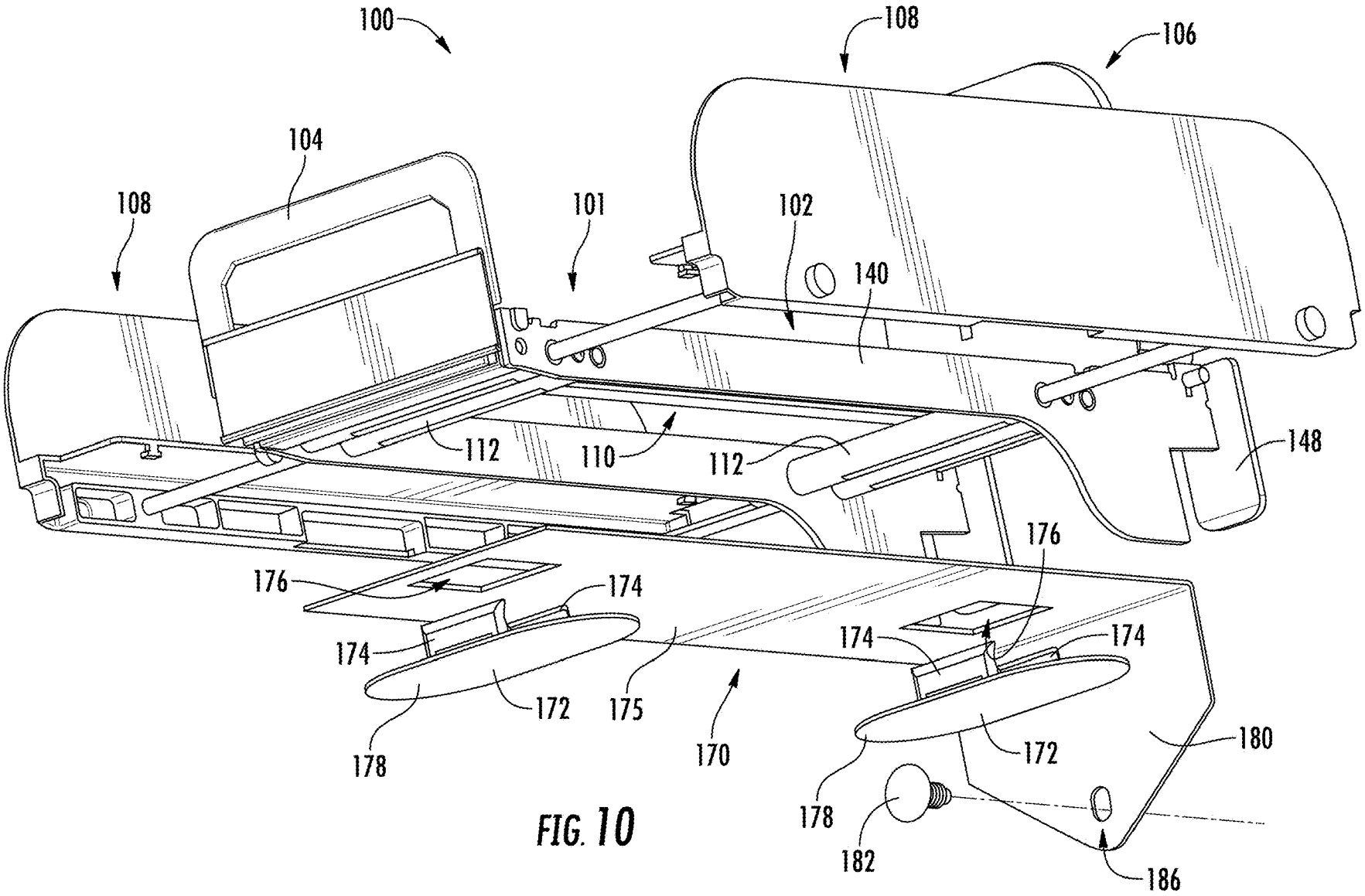
FIG. 10 is a bottom perspective and partially exploded illustration of the retail merchandise tray of FIG. 1.

With reference to FIG. 10, the tray 100 includes a baffle plate 170 that is positioned below the product support surface of the product support structure 101. In this example, the baffle plate 170 is located between the load bearing members 102 and particularly, the rails 140 thereof, but below the wire support frame 110.

The baffle plate 170 attaches to spacers 112 by clips 172. The clips 172 have a pair of flexible legs 174 that snap around front and rear sides of spacers 112 to releasably secure the baffle plate 170 thereto. The flexible legs 174 extend through apertures 176 in a longitudinally extending member 175 of the baffle plate 170. The legs 174 extend from an enlarged body portion 178 that presses against a bottom side of the longitudinally extending member 175 to secure the baffle plate 170 to the remainder of the tray 100.

The baffle plate 170 includes a downward extending locating flange 180. The locating flange 180 carries a locating pin 182. The locating pin 182 cooperates with apertures 184 in the tray support structure 103 (see FIG. 1) to properly locate the tray 100 along the tray support structure 103, e.g. along axis 165. In this example, the locating pin 182 is carried in a pin receiving aperture 186 provided by locating flange 180.

In alternative embodiments, the locating pin 182 could be unitarily formed with the locating flange 180, such as a molded rearward extending projection.

In this embodiment, the longitudinally extending member 175 and the locating flange 180 are formed as a one-piece component, such as from a single piece of metal or plastic.

In a preferred embodiment, the longitudinally extending member 175 extends along the first axis 164 at least 50% of the length of the rails 140 and more preferably at least 70%. Further, the longitudinally extending member 175 extends along the second axis 165 between the first and second rails 140 at least 80% of the spacing between the first and second rails 140.

Further, as the longitudinally extending member 175 may also be used as baffle, it is preferred that less than 10% of the longitudinally extending member 175 is imperforate. It is noted that the enlarged body portion 178 of the clips covers apertures 176. As such, these apertures do not count towards any perforate portion of the longitudinally extending member 175.

Figure 11:
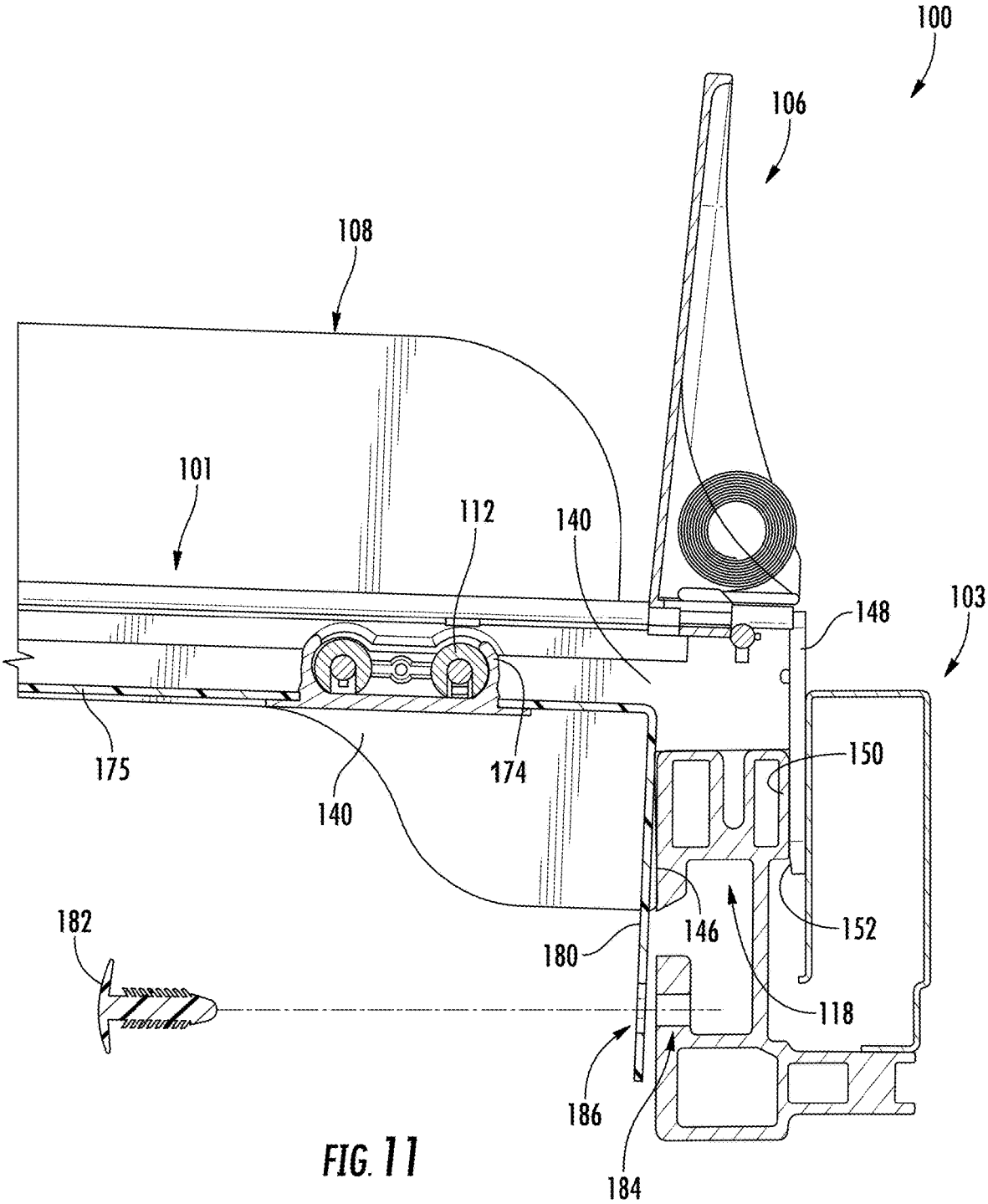
FIG. 11 is a cross-sectional illustration of the tray mounted to a tray support structure, with a locating pin removed.
Figure 12:
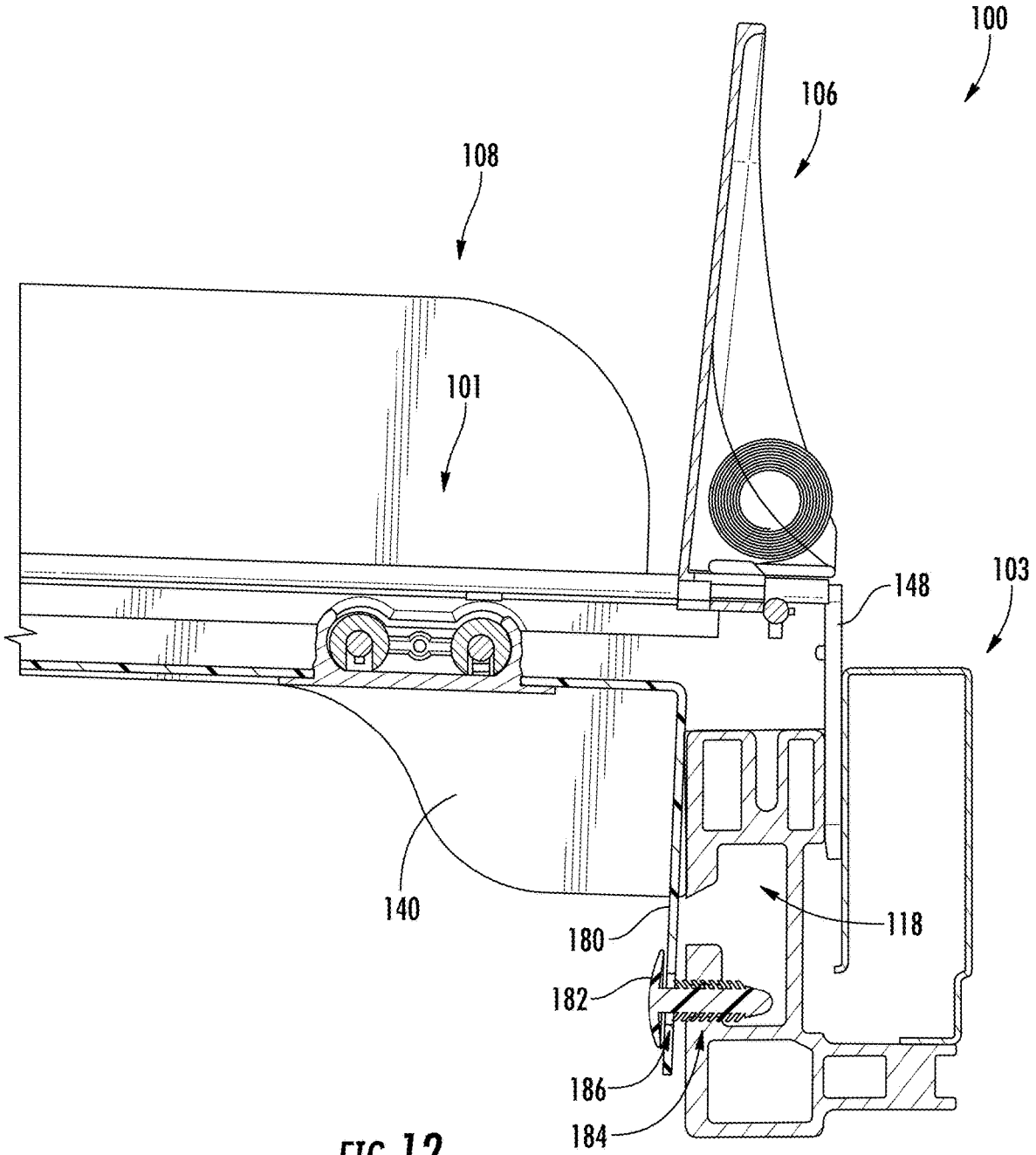
FIG. 12 is a cross-sectional illustration of the tray mounted to a tray support structure, with the locating pin inserted into the tray support structure.
Figure 13:
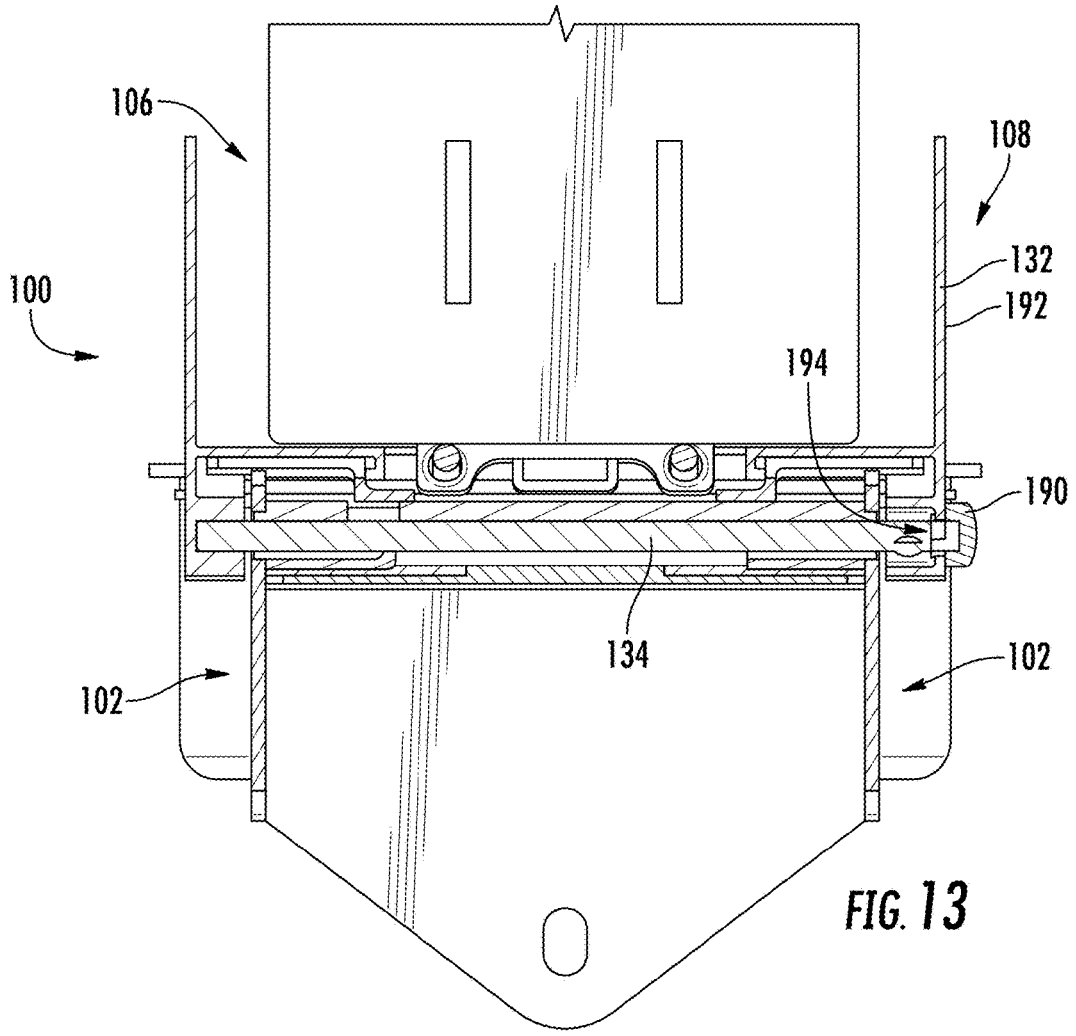
FIG. 13 is a partial cross-sectional illustration of the tray of FIG. 1.
Figure 14:
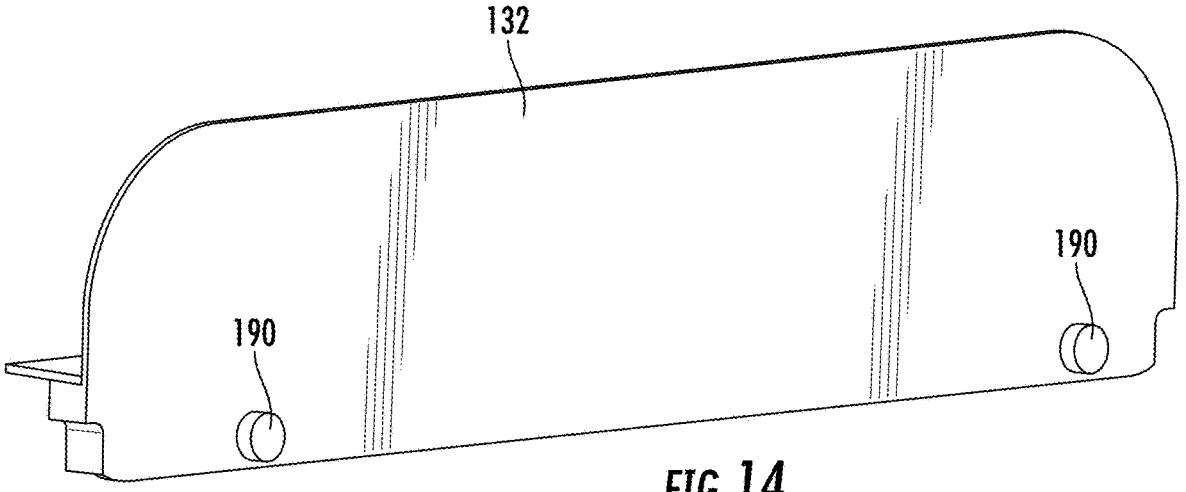
FIG. 14 is a perspective view of a divider assembly of the tray of FIG. 1.
Figure 15:
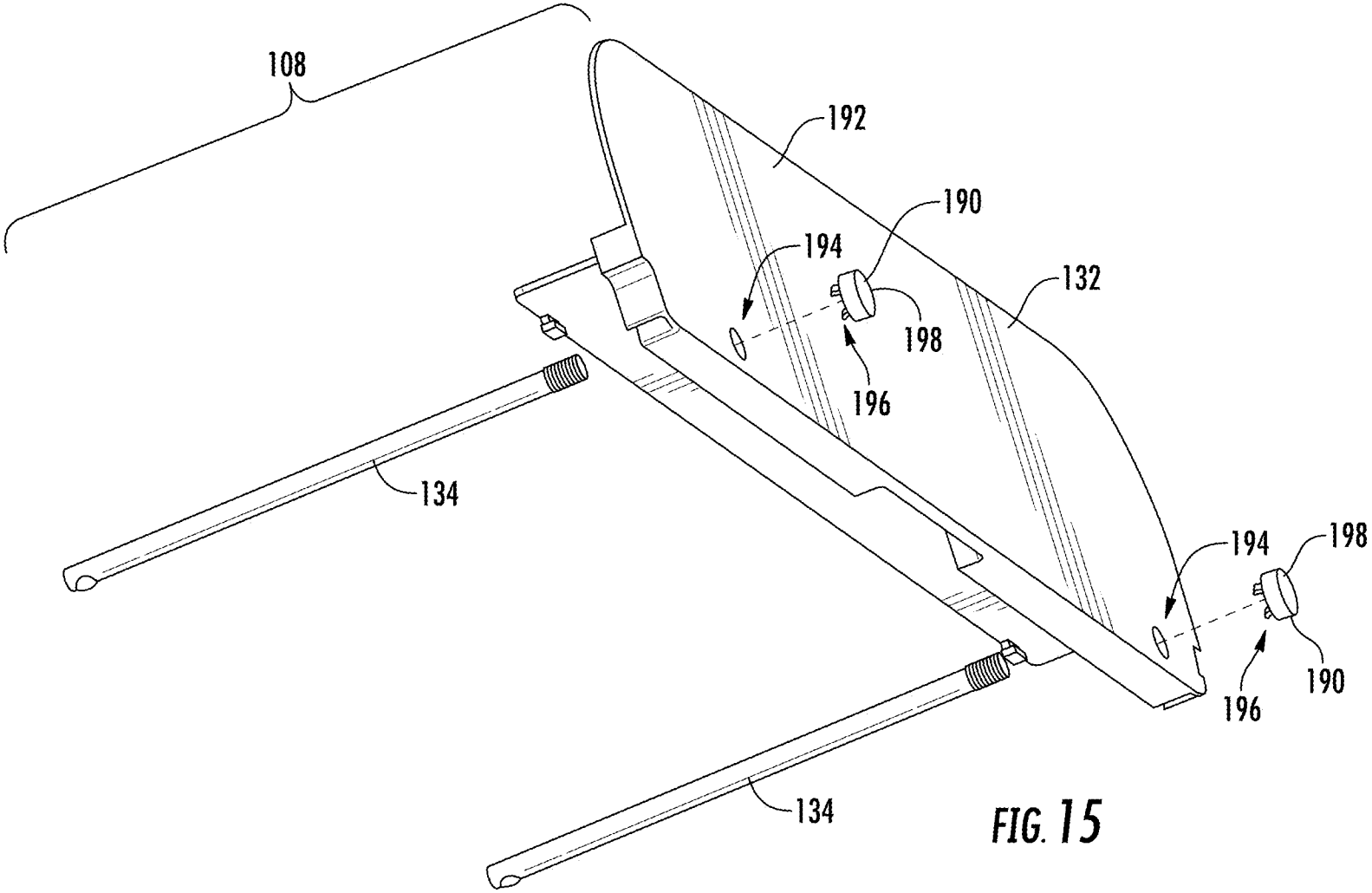
FIGS. 15 and 16 are exploded illustrations of the divider assembly of the tray of FIG. 1.
Figure 16:
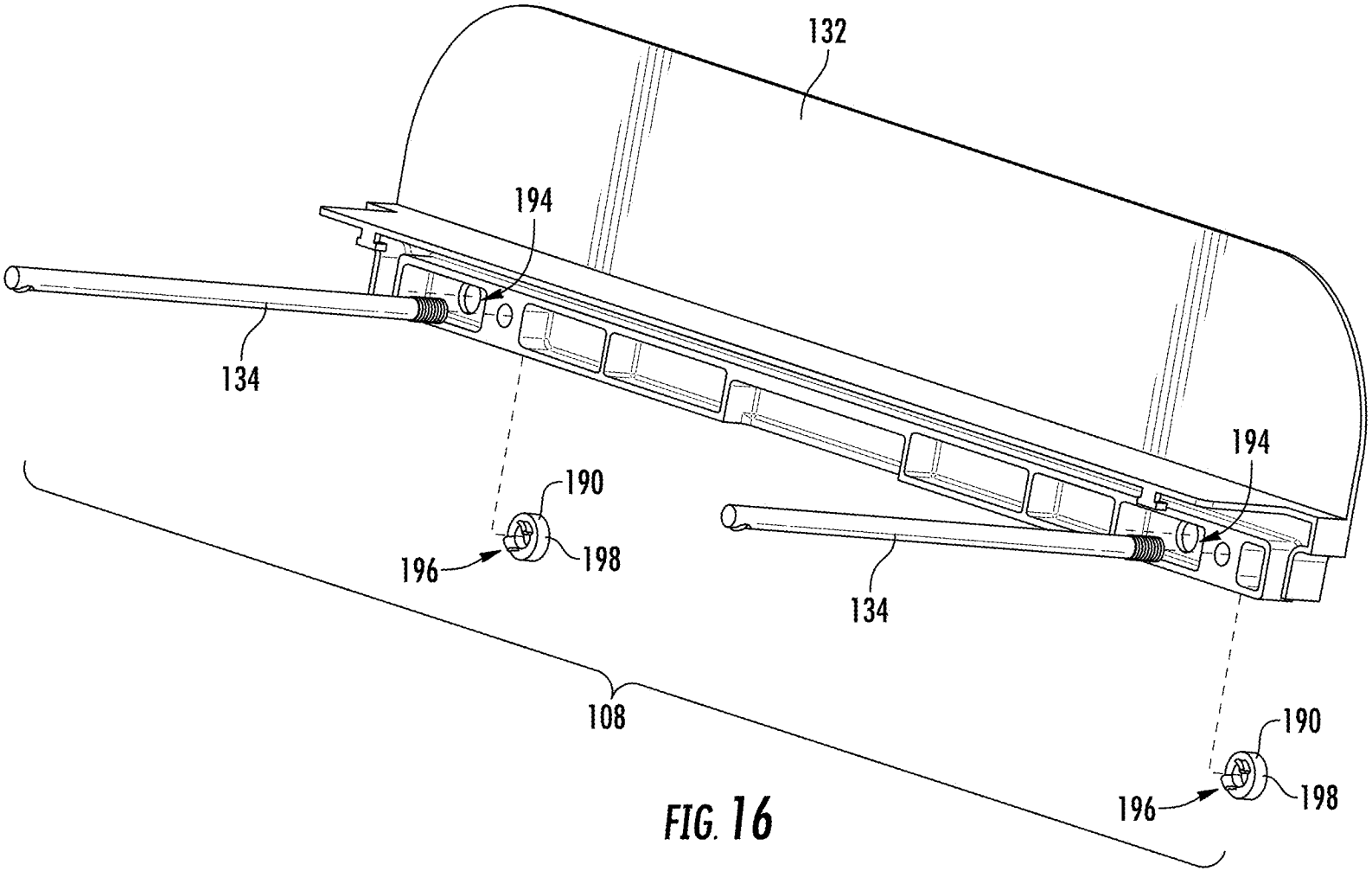

As illustrated in FIGS. 11-12, the locating flange 180 is located forward of the mounting plate 148 and extends downward farther than the downward depending abutment 146. Further, the locating flange 180 is located forward of the downward opening notch 118 as well as well as axially aligned with or forward of the downward depending abutment 146.

With reference to FIGS. 1, 3, 13 and 14, the divider walls 132 of the divider assemblies include offset projections 190 extending from an outer side 192 thereof along the second axis 165. In this embodiment, the offset projections 190 are formed from removable push pins that include a flexible mounting post 196 that are inserted into apertures 194 formed into the divider walls 132. The flexible mounting post 196 is formed from a plurality of leg portions extending from an enlarged head portion 198. The head portion 198 is larger than the diameter of apertures 194.

The offset projections 190 maintain appropriate spacing between multiple trays 100 when more than one tray 100 is mounted to the tray support structure 103.

Figure 17:
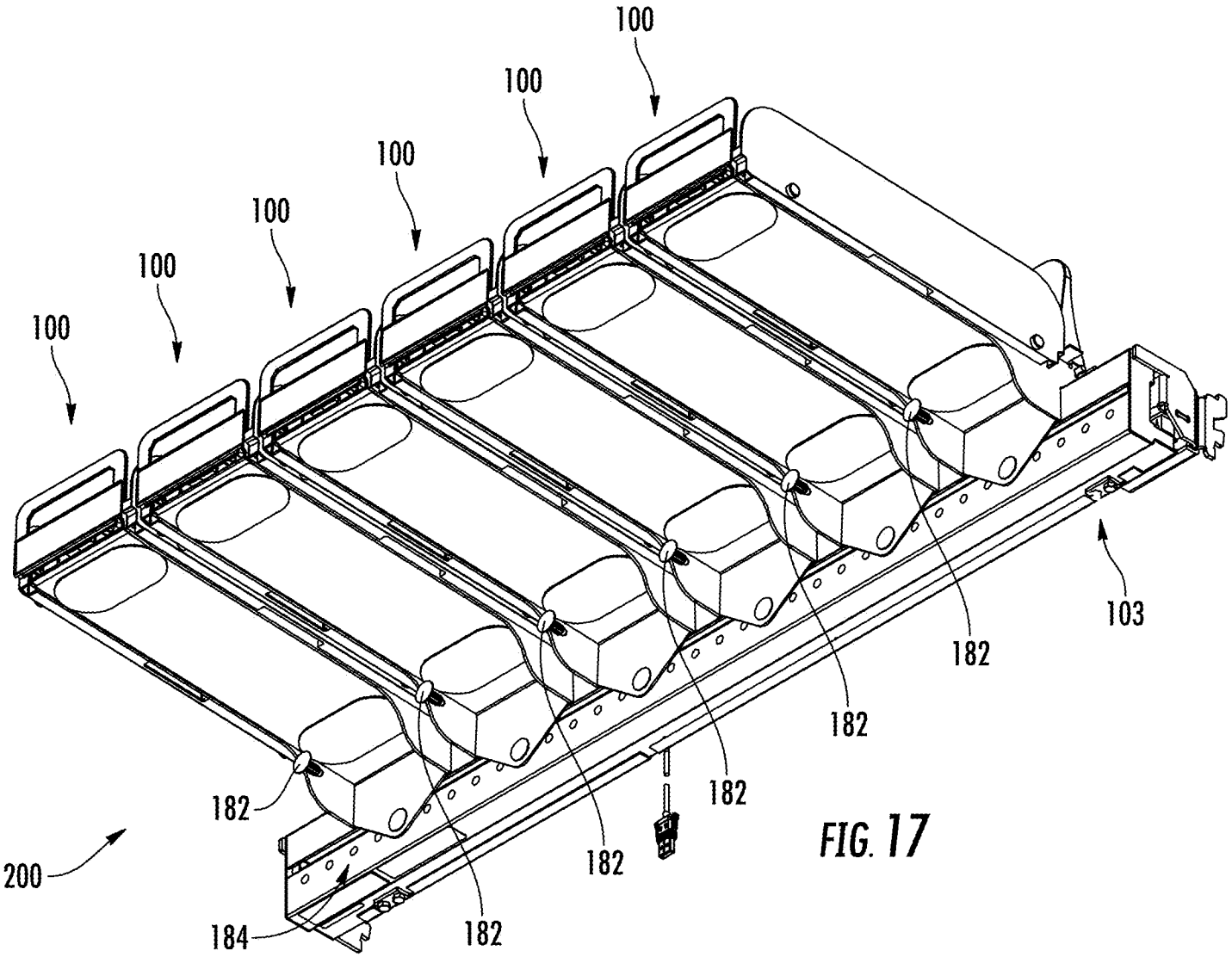
FIG. 17 is a retail merchandise display similar to FIG. 1 including a plurality of trays mounted to the tray support structure.

FIG. 17 illustrates a retail merchandise display 200 that includes a plurality of the trays 100. The offset projections 190, again, help maintain appropriate spacing of the trays 100. This can be particularly useful in systems that use load cells for mounting the trays for automated analysis of when product is removed from the retail merchandise display 200. More particularly, the offset projections 190 prevent undesirable friction or engagement between adjacent trays 100 which could adversely affect the analysis of what product is removed from the retail merchandise display 200.

The locating flange 180 and locating pin 182 also assist in proper location of the tray 100 along the tray support structure 103. This proper location also assists in the correct analysis, e.g. load sensing, that may be used to determine when/which product is removed from which tray 100.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise tray comprising:

a product support structure extending along a first axis between a front end and a rear end including:

first and second load bearing members being spaced apart about a second axis perpendicular to the first axis, each of the first and second load bearing members including:

a rail extending longitudinally generally parallel to the first axis between a first end and a second end, the first end being closer to the front end than the second end, the second end being closer to the rear end than the first end, the rail having opposed inner and outer sides, the rail including a downward depending abutment that is offset from the second end along the first axis towards the first end, the downward depending abutment facing the second end;

a mounting plate attached to the rail proximate the second end, the mounting plate extending along the second axis outward beyond the outer side and inward beyond the inner side of the rail, the mounting plate being spaced apart from the downward depending abutment along the first axis forming a downward opening notch therebetween;

a product support surface supported by the load bearing members; and a pusher mounted to the product support structure and movable along the first axis.

2. The retail merchandise tray of claim 1, wherein for each of the first and second load bearing members:

the mounting plate includes a slot formed therein; and a portion of the rail extends into the slot.

3. The retail merchandise tray of claim 2, wherein for each of the first and second load bearing members:

the mounting plate defines a front face that faces the front end and a rear face that is opposed to the front face that faces away from the front end;

the slot is formed by an aperture that extends entirely through the mounting plate and through the front and rear faces; and the rail being welded to the mounting plate by a weld formed in at least the rear face of the mounting plate.

4. The retail merchandise tray of claim 3, wherein for each of the first and second load bearing members, the rail extends no farther rearward than the rear face of the mounting plate.

5. The retail merchandise tray of claim 1, wherein for each of the first and second load bearing members, the mounting plate is welded to the rail.

6. The retail merchandise tray of claim 1, wherein the mounting plate has a first thickness measured generally parallel to the first axis that is greater than a second thickness of the rail measured generally parallel to the second axis.

7. The retail merchandise tray of claim 6, wherein the first thickness is greater than the second thickness.

8. The retail merchandise tray of claim 6, wherein the first thickness is less than 0.25 inches.

9. The retail merchandise tray of claim 6, wherein the second thickness is less than 0.25 inches.

10. The retail merchandise tray of claim 6, wherein the first thickness is at least 25% greater than the second thickness.

11. The retail merchandise tray of claim 1, wherein the downward depending abutment extends downward farther than the mounting plate.

12. The retail merchandise tray of claim 1, further comprising:

a locating flange extending downward below the product support surface, the locating flange being spaced forward of the mounting plate along the first axis; and a locating pin extending rearward of the locating flange and into axial overlap with the downward opening notch along the first axis.

13. The retail merchandise tray of claim 12, wherein the locating flange extends downward farther than the downward depending abutment of each of the first and second rails.

14. The retail merchandise tray of claim 12, wherein the locating flange is formed as part of a removable baffle plate that is removably attachable to the product support structure, the removable baffle plate having a longitudinally extending member extending along the first axis and being positioned below the product support surface.

15. The retail merchandise tray of claim 14, wherein the longitudinally extending member extends along the first axis at least 50% the length of the first and second load bearing members and extends along the second axis at least 80% of the spacing between the first and second load bearing members.

16. The retail merchandise tray of claim 14, wherein less than 10% of the cross-sectional area of the longitudinally extending member is perforate.

17. The retail merchandise tray of claim 14, wherein the longitudinally extending member and the locating flange are formed as a continuous one-piece construction.

18. The retail merchandise tray of claim 12, wherein the locating pin is carried by the locating flange.

19. The retail merchandise tray of claim 18, wherein the locating flange includes a pin receiving aperture formed therein, the locating pin extending through the pin receiving aperture.

20. The retail merchandise tray of claim 1, further comprising a first divider assembly having a divider wall and a pair of wire supports, the wire supports operably attaching the divider assembly to the product support structure, the divider wall having an inner side facing the product support structure and an opposed outer side facing away from the product support structure and the inner side, the divider wall having apertures extending through the outer side, the divider assembly including an offset projection projecting outward along the second axis from the outer side.

21. The retail merchandise tray of claim 20, wherein the offset projection is mounted to the divider wall by having a mounting post pressed into one of the apertures.

22. A retail merchandise tray comprising:

a product support structure extending along a first axis between a front end and a rear end including:

first and second load bearing members being spaced apart about a second axis perpendicular to the first axis, each of the first and second load bearing members including a downward opening notch;

a product support surface supported by the load bearing members;

a locating flange extending downward below the product support surface, the locating flange being spaced forward of the downward opening notch along the first axis; and a locating pin extending rearward of the locating flange and into axial overlap with the downward opening notch along the first axis; and a pusher mounted to the product support structure and movable along the first axis.

23. The retail merchandise tray of claim 22, wherein the locating flange extends downward farther a portion of the first load bearing member that defines the downward opening notch thereof, and the locating flange extends downward farther than a portion of the second load bearing member that defines the downward opening notch thereof.

24. The retail merchandise tray of claim 22, wherein the locating flange is formed as part of a removable baffle plate that is removably attachable to the product support structure, the removable baffle plate having a longitudinally extending member extending along the first axis and being positioned below the product support surface.

25. The retail merchandise tray of claim 24, wherein the longitudinally extending member extends along the first axis at least 50% the length of the first and second load bearing members and extends along the second axis at least 80% of the spacing between the first and second load bearing members.

26. The retail merchandise tray of claim 24, wherein less than 5% of the cross-sectional area of the longitudinally extending member is perforate.

27. The retail merchandise tray of claim 24, wherein the longitudinally extending member and the locating flange are formed as a continuous one-piece construction.

28. The retail merchandise tray of claim 22, wherein the locating pin is carried by the locating flange.

29. The retail merchandise tray of claim 28, wherein the locating flange includes a pin receiving aperture formed therein, the locating pin extending through the pin receiving aperture.

30. A retail merchandise tray comprising:

a product support structure extending along a first axis between a front end and a rear end including:

first and second load bearing members being spaced apart about a second axis perpendicular to the first axis, each of the first and second load bearing members including:

a rail extending longitudinally generally parallel to the first axis between a first end and a second end, the first end being closer to the front end than the second end, the second end being closer to the rear end than the first end, the rail having opposed inner and outer sides, the rail including a downward depending abutment that is offset from the second end along the first axis towards the first end, the downward depending abutment facing the second end;

a mounting plate attached to the rail proximate the second end, the mounting plate extending along the second axis outward beyond the outer side and inward beyond the inner side of the rail, the mounting plate being spaced apart from the downward depending abutment along the first axis forming a downward opening notch therebetween, the mounting plate including a slot formed therein, a portion of the rail extending into the slot; and a product support surface supported by the load bearing members.

* * * * *